United States Patent [19]

Hara et al.

[11] Patent Number: 4,707,638

[45] Date of Patent: Nov. 17, 1987

[54] LUMINANCE ADJUSTING SYSTEM FOR A FLAT MATRIX TYPE CATHODE-RAY TUBE

[75] Inventors: Zenichirou Hara; Ichirou Iwatsuji, both of Nagasaki, Japan

[73] Assignee: Mitsubishi Denki Kabushiki Kaisha, Tokyo, Japan

[21] Appl. No.: 7,148

[22] Filed: Jan. 27, 1987

[51] Int. Cl.[4] ..... G09G 3/10

[52] U.S. Cl. ..... 315/169.3; 315/DIG. 4; 315/1; 315/366; 315/383; 313/422

[58] Field of Search ..... 315/169.3, DIG. 4, 366, 315/383; 340/767, 793, 825.79; 313/422

[56] References Cited

U.S. PATENT DOCUMENTS

| | | | |
|---|---|---|---|
| 3,629,653 | 12/1971 | Irwin | 315/169.3 |
| 4,067,047 | 1/1978 | Ryan | 340/793 |
| 4,542,322 | 9/1985 | Irie et al. | 315/366 |
| 4,654,559 | 3/1987 | Hinotani et al. | 313/422 |

*Primary Examiner*—Harold Dixon

*Attorney, Agent, or Firm*—Sughrue, Mion, Zinn, Macpeak & Seas

[57] ABSTRACT

A flat matrix cathode-ray tube (CRT) in which the brightness of a display picture can be readily adjusted according to environmental brightness. In the flat matrix CRT, the grid electrodes are made up of the scanning electrodes and the data electrodes which form the matrix structure with the scanning electrodes, and the pulse voltage for gradations required are applied selectively to the scanning electrodes and the data electrodes so that the picture elements determined by the scanning electrodes and the data electrodes to which the pulse voltage are selectively applied are caused to emit light. Slots the number of which is determined in correspondence to the number of gradations selected, are provided either in the waveforms of the voltages applied to the scanning electrodes or in the waveforms of the voltages applied to the data electrodes in such a manner that the slots occur at regular intervals.

4 Claims, 11 Drawing Figures

PRIOR ART

LUMINANCE ADJUSTING SYSTEM FOR A FLAT MATRIX TYPE CATHODE-RAY TUBE

BACKGROUND OF THE INVENTION

1. Field of the Invention

This invention relates to a luminance adjusting system for a flat matrix type cathode-ray tube(CRT), which controls the brightness of a picture displayed on the CRT according to environmental brightness.

2. Description of the Prior Art

An example of a conventional flat matrix type CRT is so designed that grid electrodes are made up of a plurality of scanning electrodes and a plurality of data electrodes which are arranged to form a matrix structure together with the scanning electrodes, and pulse voltages of predetermined gradations are applied selectively to selected ones of the electrodes in the two different groups to cause the picture elements corresponding to the selected electrodes to emit light.

In this operation, as is well known in the art, electrons emitted from a direct-heating type linear filament are accelerated by the voltages applied to the grid electrodes consisting of the scanning electrodes and the data electrodes, to impinge an anode at a high voltage, whereby a light emitting material such as a fluorescent layer which is formed on the anode by coating, is caused to emit light by the energy of collision.

FIG. 1 shows the grid electrode structure of the flat matrix type CRT. In the flat matrix type CRT, the grid electrode structure is a 4×4 matrix structure consisting of scanning electrodes X1 through X4 and data electrodes Y1 through Y4. In correspondence to the 4x4 matrix structure, fluorescent substances of red, green and blue are applied to the predetermined parts of the anode surface (not shown) as required, so that sixteen (16) picture elements in one element can appear red (R), green(G), and blue (B).

A desired one of the picture elements can be selected by applying voltages to the scanning electrode and the data electrode which are provided for the picture element. And only the picture element thus selected can emit light.

FIGS. 2(*a*) through 2(*e*) are diagrams for a description of the display system in which, in the halftone display by the above-described conventional CRT, one field is divided into four parts, and, in a ¼ duty, display is carried out with 64 gradations. FIGS. 2(*a*) through 2(*d*), reference characters $GX_1$ through $GX_4$ designate the voltage waveforms of scanning signals applied to the scanning electrodes X1 through X4 shown in FIG. 1, respectively. In FIG. 3(*e*), reference character GY designates the pulse-width-controlled voltage waveform of one of data signals $GY_1$ through $GY_4$ respectively applied to the data electrodes $Y_1$ through $Y_4$ shown in FIG. 1. When the scanning signal and the data signal are both at the high level, the corresponding picture element is caused to emit light. In FIG. 2(*e*), reference character $T_B$ designates a blanking time.

In the above-described conventional CRT, of the video signal to be displayed, only the parts corresponding to brightness instructions are subjected to light emission control. That is, only the degrees of brightness on the display instruction are adjusted by the pulse width control of the data signals. Accordingly, for the CRT, it is impossible to perform the adjustment of the brightness of a display picture according to the environmental brightness. Therefore, depending on the environmental brightness, the display picture becomes difficult to observe.

SUMMARY OF THE INVENTION

Accordingly, an object of this invention is to eliminate the above-described difficulty accompanying a conventional flat matrix CRT. More Specifically, an object of the invention is to provide a luminance adjusting system for a flat matrix type CRT, which is capable of controlling the brightness of a picture according to environment brightness.

The above and other objects of the present invention are met by the provision of a luminance adjusting system for a flat matrix type CRT in which grid electrodes consists of a plurality of scanning electrodes and a plurality of data electrodes which are arranged to form a matrix structure with the scanning electrodes, and pulse voltages for gradations required are supplied selectively to the scanning electrodes and data electrodes so that picture element determined by the scanning electrodes and data electrodes to which the pulse voltages are supplied are caused to emit light, and further, according to the invention, slots are provided either in the waveforms of pulse voltages applied to the scanning electrodes or in the waveforms of pulse voltages applied to the data electrodes in such a manner that the thus provided slots occur at regular intervals, and the number of slots are determined in correspondence to that of gradations required, whereby the luminance of the CRT is made adjustable.

BRIEF DESCRIPTION OF THE DRAWINGS

In the accompanying drawings,

FIGS. 2(*a*) through 2(*e*) are waveform diagrams for a description of the operation of a conventional flat matrix CRT; and FIGS. 3(*a*) through 3(*e*) are waveform diagrams for a description of one embodiment of this invention.

DESCRIPTION OF THE PREFERRED EMBODIMENT

Figure 1:
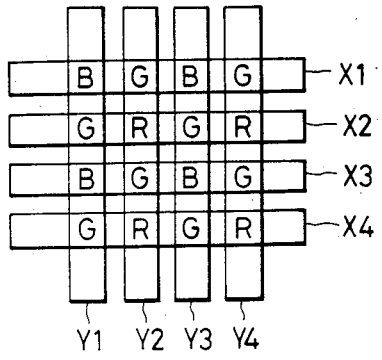
FIG. 1 PRIOR ART
FIG. 1 is an explanatory diagram showing the structure of grid electrodes in the CRT to which the technical concept of the invention is applied.
Figure 1:
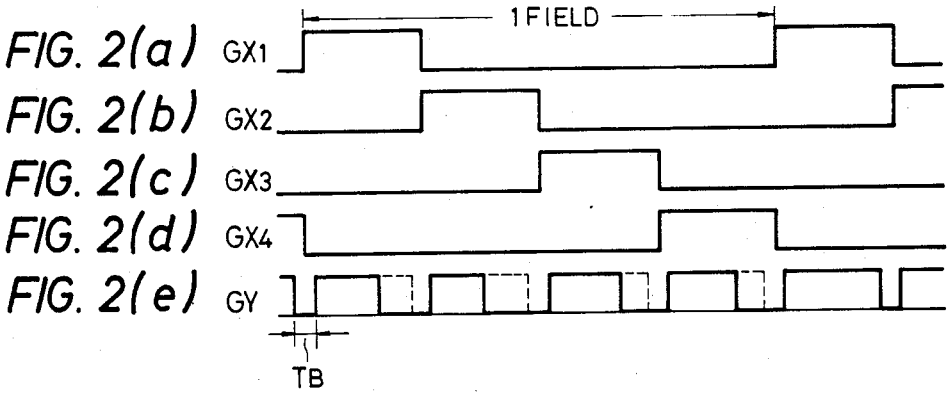
FIG. 1 PRIOR ART
Figure 1:
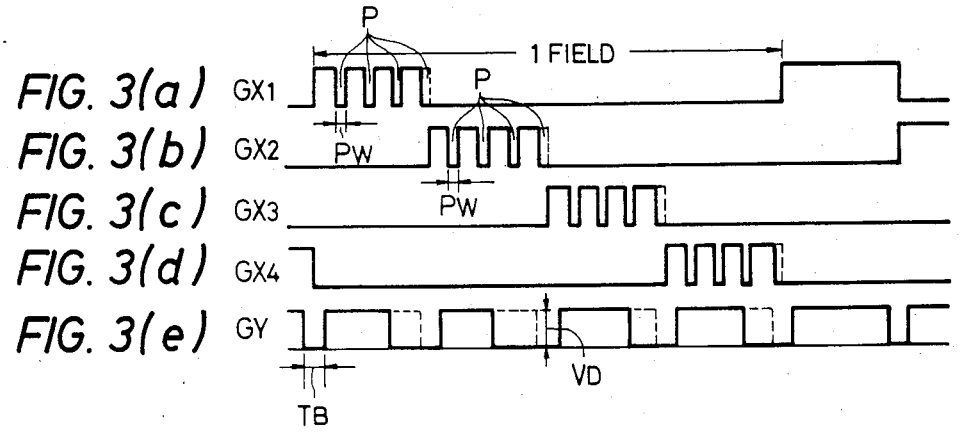
FIG. 1 PRIOR ART

A preferred embodiment of this invention will be described with reference to FIGS. 3(*a*) through 3(*e*) corresponding to FIGS. 2(*a*) through 2(*e*). For convenience in description, in FIGS. 3(*a*) through 3(*e*), the number of gradations is four(4). As shown in FIGS. 3(*a*) through 3(*d*), four (n=4) slots P corresponding to the number of gradations are provided in each of the waveforms of the voltages $GX_1$ through $GX_4$ applied respectively to the scanning electrodes X1 through X4 in such a manner that the slots P occur at predetermined intervals. The voltage signals $GX_1$ through $GX_4$ each having slots are easily obtained by a well-known manner. For example, ordinary scanning signals and a brightness control slot signal are applied to AND gates to be subjected to logical product operation. Then, the outputs of the AND gates are applied to the scanning electrodes $X_1$ through $X_4$ as the voltage signals $GX_1$ through $GX_4$.

Accordingly, when the voltages applied to the scanning electrodes are controlled as described above, light emission is effected for the period that the voltage applied to the scanning electrode and the voltage (shown in FIG. 3(*e*)) applied to the data electrode are both at the high level, and it is not effected for the period that the slot P occurs. Therefore, in the case when the environmental brightness is low, the display picture can be made uniformly dark, which facilitates the observation of the picture. Furthermore, by controlling the width $P_W$ of the slot P, the brightness of the display picture can be controlled as required.

In the luminance adjusting system for the flat matrix type CRT, according to the invention, as was described above, the slots P are provided in the waveforms of pulse voltages applied to the scanning electrodes in such a manner that the slots P occur at regular intervals and the number of slots P are determined in correspondence to the number of gradations required, whereby the brightness of the picture displayed on the CRT can be adjusted. Furthermore, the width PW of the slots P is controlled to adjust the brightness of the display picture.

It goes without saying that the slots P may provided in the waveforms of the voltages applied to the data electrodes instead of the scanning electrodes. That is, all that is necessary is to provide the slots P either in the waveforms of the voltages applied to the scanning electrodes or in the waveform of the voltages applied to the data electrodes in such a manner that the slots occur at regular intervals, and the number of slots P are determined in correspondence to the number of gradations selected.

What is claimed is:

1. A luminance adjusting system for a flat matrix CRT in which grid electrodes comprise a plurality of scanning electrodes and a plurality of data electrodes which are arranged to form a matrix structure with said scanning electrodes, and pulse voltages for gradations required are applied selectively to said scanning electrodes and data electrodes so that picture elements determined by said scanning electrodes and data electrodes to which said pulse voltages are applied are caused to emit light, slots being provided in the waveforms of pulse voltages applied to said grid electrodes in such a manner that said slots occur at regular intervals, and the number of slots being determined in correspondence to the number of gradations required, to thereby make the luminance of said CRT adjustable according to environmental brightness.

2. A luminance adjusting system as claimed in claim 1, wherein the width of said slots is controlled to adjust the brightness of a displayed picture.

3. A luminance adjusting system as claimed in claim 1, wherein said slots are provided in the waveforms of pulse voltages applied to said scanning electrodes of said grid electrodes.

4. A luminance adjusting system as claimed in claim 1, wherein said slots are provided in the waveforms of pulse voltages applied to said data electrodes of said grid electrodes.

* * * * *